US006494455B1

(12) United States Patent
Headrick

(10) Patent No.: US 6,494,455 B1
(45) Date of Patent: Dec. 17, 2002

(54) FLYING DISC ENTRAPMENT DEVICE

(75) Inventor: Edward E. Headrick, Watsonville, CA (US)

(73) Assignee: Disc Golf Association, Inc., Watsonville, CA (US)

( * ) Notice: Subject to any disclaimer, the term of this patent is extended or adjusted under 35 U.S.C. 154(b) by 0 days.

(21) Appl. No.: 09/953,520

(22) Filed: Sep. 13, 2001

(51) Int. Cl.[7] ..... A63B 67/06
(52) U.S. Cl. ..... 273/400; 473/476
(58) Field of Search ..... 273/398, 400, 273/401, 476, 479

(56) References Cited

U.S. PATENT DOCUMENTS

| | | | | | |
|---|---|---|---|---|---|
| 4,039,189 | A | | 8/1977 | Headrick et al. | |
| 4,461,484 | A | | 7/1984 | Headrick | |
| 4,792,143 | A | | 12/1988 | Headrick | |
| 4,809,988 | A | * | 3/1989 | Hunter | 273/400 |
| 5,048,845 | A | * | 9/1991 | Dunipace | 273/400 |
| 5,358,255 | A | * | 10/1994 | Jolson | 273/400 |
| 5,452,903 | A | * | 9/1995 | Larrabee | 273/381 |
| 5,868,395 | A | | 2/1999 | Headrick | |
| 5,893,563 | A | * | 4/1999 | Buller | 273/400 |
| 5,921,551 | A | * | 7/1999 | Dunipace | 273/400 |
| 5,941,529 | A | * | 8/1999 | Kinsey | 273/401 |
| 5,944,318 | A | * | 8/1999 | Payton | 273/402 |
| 6,250,635 | B1 | * | 6/2001 | Chittenden | 273/400 |

* cited by examiner

*Primary Examiner*—Mark S. Graham
(74) *Attorney, Agent, or Firm*—Christie, Parker & Hale, LLP

(57) ABSTRACT

A pole mounted basket and chain assembly for use with flying disc golf courses. A chain assembly is provided with a total of 24 chains located at spaced intervals around the pole, a first inner set of 12 and an outer set of 12. At the upper end each inner chain is attached to a support radially extending from the pole or post. At the lower end the inner chains are attached to a horizontal ring of links. A second outer set of chains attached to a second larger support mounted at the top of the pole extend vertically downward and are also attached to the horizontal ring at their lower ends. A basket is attached to the pole below the lower end of the chains with the pole passing through the center of the basket. Flying discs impacting the chains have their energy absorbed by the chains and the discs drop vertically into the basket.

17 Claims, 10 Drawing Sheets

FLYING DISC ENTRAPMENT DEVICE

BACKGROUND OF THE INVENTION

This invention relates to pole-mounted chain and basket assemblies, and in particular to flying disc entrapment devices.

The game of disc golf has been a popular pastime for the past twenty-five years. This game is played in a variety of ways, but in its essential form it simulates the game of golf by providing one or more golf-type holes over a course laid out in an open recreational area such as a park or the like. Each golf hole consists of the usual essential elements—a tee, a fairway, a selection of hazards and a location for "putting out." This putting location is occupied by what has become known as a Disc Pole Holes® disc entrapment device. Earlier versions of Disc Pole Holes® disc entrapment devices are described and claimed in U.S. Pat. Nos. 4,039,189; 4,461,484; 4,792,143; and 5,868,395.

Each of the flying disc entrapment devices described in the foregoing patents has certain advantages and have represented advances in the state of the art as disc golf courses have become developed over the years, and as further refinements have been added to the game of disc golf and to the layout of individual golf holes. These refinements have included improvements in the design and structure of flying disc entrapment devices. Following the basic design, each development added a further improvement, including a specific design to prevent vertical penetration fly-through, bounce-out after the disc strikes the central pipe, and the improvement that allowed discs to be caught, even ones that struck the very top links at the top of the disc pole hole.

Such entrapment devices all utilize at least one solid steel ring to which the vertical chains are attached at their lower end forming a small circle around the central pipe, which prevents the chains from flying out of control when struck by a disc. The ring served the purpose well and has been the source of significant imitation. When a disc strikes the first chain of a series of hanging chains each tracing a parabolic curve from top to lower end, the weight of typically 18 links in each vertical chain is partially lifted, thereby absorbing the energy of the impacting disc. Added to this is the weight of the solid ring plus the weight of several links which are attached to the ring on either side of the impacted chain. Since there are several adjacent chains which are usually struck or partially lifted by the disc at the moment of impact, the amount of resistance to the disc increases exponentially. This cooperative functioning of the chains attached to a solid base ring is particularly useful and performs particularly well when the incoming disc is traveling at a high rate of speed and strikes the disc entrapment device right in the center of the chains. When this occurs, the disc is almost always caught because the forces on either side are symmetrical, and there is nothing that causes it to be deflected or mis-directed from its flight path.

Problems are encountered, however, when the impact of the disc is off-center; that is, when it impacts chains to the left or to the right of the center pole when viewed straight on. In this case, the forces that stop the disc when the disc impacts the center of the assembly now tend to push the disc away from the entrapment device with a force which increases as the spinning disc impacts first one and then another in a succession of chains as it spins on its escape path. The flight of the disc and its tendency to be either caught or spun away is further impacted by whether the disc has had a left-hand spin or a left-hand spin imparted to it. A left-hand spin will further add to the tendency to fly away when it strikes the chains on the right-hand side of center, and similarly, a right-hand spin will produce the same effect when the impact is to the left of center.

Further experimentation has led to the conclusion that the minimum amount of energy required to catch or stop a disc should be the maximum amount of force provided to stop the forward motion of the disc and allow gravity to pull the disc into the basket. In further analysis, it has been concluded that the use of a solid ring to secure the chains at the base of the parabola provides too much energy, and an alternative has been developed which is the subject of the present application.

SUMMARY OF THE INVENTION

The present invention provides a pole-mounted chain and basket assembly for catching and holding flying discs which comprise a vertically mounted elongated pole and a first support element extending radially outwardly a first distance from the pole adjacent the upper end of the pole. A first plurality of vertically oriented inner chains are provided, with the chains connected at spaced intervals at their upper ends to the first support, and at their lower ends are connected to a horizontal ring of links extending between each vertical chain and encircling the pole. A second support element also extends radially outwardly from the pole a second greater distance than the first distance. A second plurality of vertically oriented outer chains encircling the first plurality are provided, each of the second plurality of chains being attached at spaced intervals at their upper ends to the second support and to the horizontal ring of links at their lower ends. An upwardly-opening basket of predetermined size is attached to the pole below the lower ends of the two pluralities of chains and the horizontally ring. The plurality of chains are of a predetermined size, shape and weight, such that when the assembly is struck by a flying disc they act to capture the disc, absorbing disc kinetic energy and causing the flying disc to fall into the basket.

The present invention solves the problems presented by prior art disc entrapment device in several ways. By eliminating the solid ring and using two sets of chains (one inner set and one outer set) of a pre-determined size, shape and weight, it has been found that the cooperative action of the adjacent chains produces surprising and unexpected results in demonstrating an ability to absorb the energy of the incoming disc as it strikes the chains and be restrained from imparting a reaction or rebound effect, thereby enabling the kinetic energy of the disc to be absorbed and allow gravity to exert its force, causing the disc to fall into the basket below the chain assembly. This chain assembly, where all chains are comprised of chain links, can be referred to as "soft chains" because of the absence of the solid ring.

A second valuable improvement is obtained by a preferred embodiment of the present invention by providing two sets of seven (7) chains located at spaced intervals around the disc pole hole in concentric fashion, each supported by a radially-extending support extending outwardly from the central pole. The chains are attached to the extremities of these supports and extend vertically downward in a parabolic curve to a series of horizontally oriented links which form a horizontal chain ring linking the inner set of chains to each other, linking the outer set of chains to each other, and the two sets of inner and outer chains to each other.

The performance of the disc pole hole with this configuration is improved in a number of respects. The distance from the chains to the inner pole is maintained greater than the diameter of the discs. Incoming discs, in some cases, pass between the chains and strike the pole. This plus the relative spacing of adjacent chains allows the chains to close behind the disc after it passes through the chains, and in effect provides a curtain to block the disc and its tendency to rebound, thus enabling the chains to grip and hold the disc. Because the links of each chain are of a pre-determined size shape and weight, each of the plurality of chains have greater flexibility and provide a greater capability in capturing discs, either light or heavy discs, even discs moving at high velocity. The spacing of the chains relative to each other provides a substantially enhanced stopping force. The horizontal ring of links joining the inner and other vertical chains moderates the movement of the impacted chains enhancing the disc catching capability of the assembly.

BRIEF DESCRIPTION OF THE DRAWINGS

The foregoing are the advantages of the present invention will be better understood by reference to the figures of the drawing wherein.

DETAILED DESCRIPTION OF THE INVENTION

Figure 1:
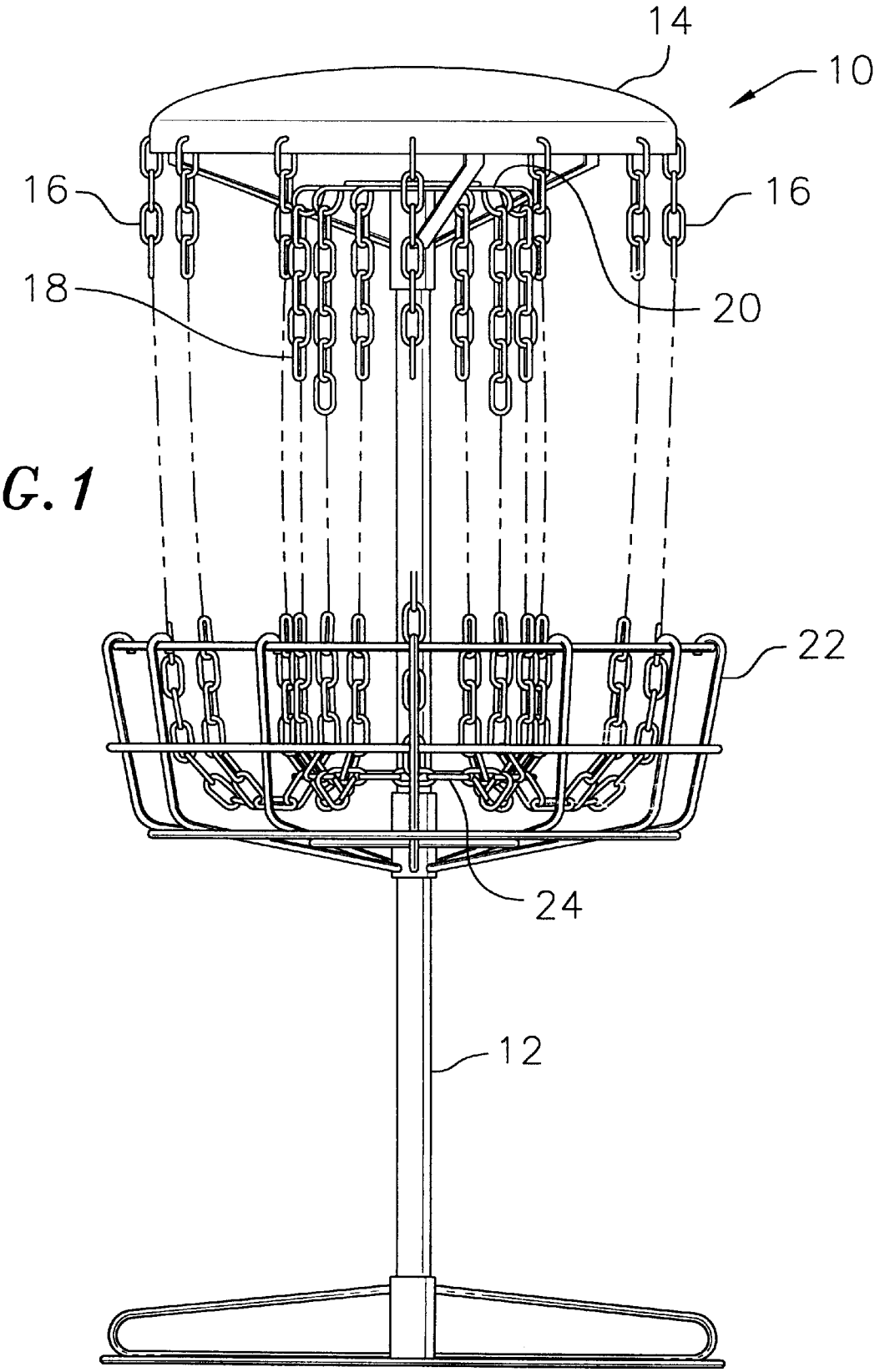
FIG. 1 is an elevation view of a disc entrapment device according the present invention.

The structure shown in FIG. 1 is a disc entrapment device 10 according to the present invention comprising a central pole 12, a domed top 14, a plurality of outer chains 16 suspended from the outer periphery of the dome and a plurality of inner chains 18 located interiorly of chains 16 and suspended from a central support 20 affixed to the pole. Chains 16 and 18 hang essentially vertically from their respective supports to a position spaced a predetermined distance above a disc catching basket 22. The bottom links of the inner chains 18 extend below the plane of the ring, loop upwardly and are connected to a horizontal ring 23 of links 24 at spaced intervals around the periphery of the ring 23. Similarly, the bottom ends of the outer chains 16 are likewise connected to the horizontal ring 23 of links at their bottom ends after extending below the plane of the horizontal ring and looping upwardly to their connection point on the horizontal ring. The links of the vertical chains are typically oblong closed loop convention chain links.

In the presently preferred embodiment there are seven (7) outer chains and there are seven (7) inner chains. The pattern of chains shown in FIG. 1 has been found to have an enhanced disc catching ability because of the flexibility of the assembly of outer chains and inner chains and the cooperative reaction of these two sets of chains and the horizontal ring of links to the impact of a flying disc which is thrown at the entrapment device. The use of a horizontal ring of links has the effect of "softening" the reaction of the overall chain assembly to the impact of an incoming disc.

When the incoming disc encounters the chains, the kinetic energy of the disc is transferred to the chains and downwardly through the chains to the horizontal ring of links causing the chains to deflect and the ring to rise upwardly along the central pole 12 absorbing the energy of the disc and allowing it to stop its flight and for gravity to exert its forces and cause the disc to be deposited in the basket thus effectively "putting out."

Figure 2:
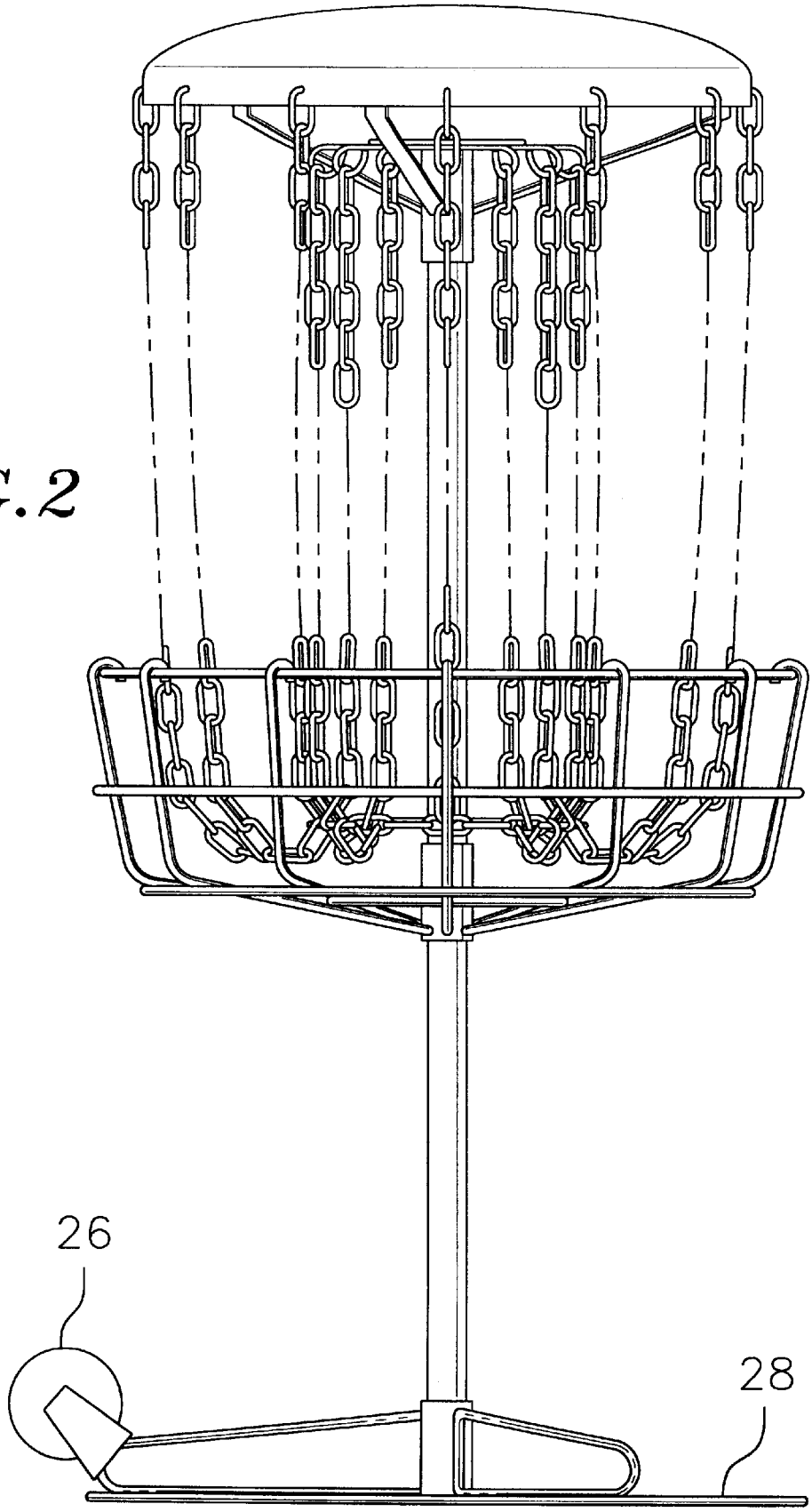
FIG. 2 is a side elevation view of the entrapment device shown in FIG. 1.

A side elevation view of the disc entrapment device according to the present invention is shown in FIG. 2. The structure is further characterized by the provision of a wheel 26 which is attached to a base member 28. The entrapment device of the present invention can thus be portable and easily movable by tilting the entrapment device so that it rests on wheel 26 and can be wheeled throughout an area where a disc golf course is to be established thereby enabling many areas to be used as disc golf courses and to enable the arrangement and rearrangement of the course layout in a given area.

Figure 3:
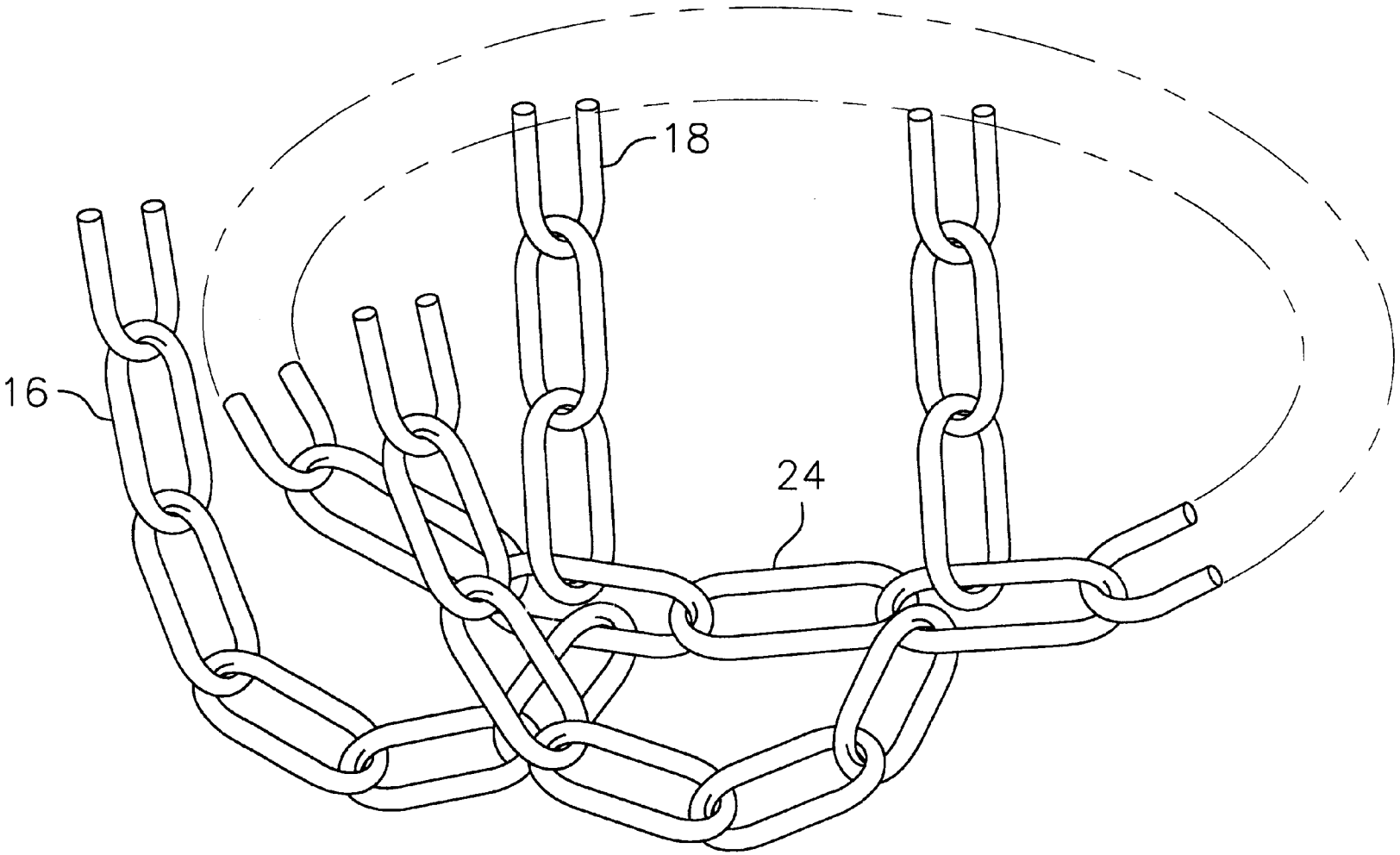
FIG. 3 is a enlarged fragmentary view of the lower portion of the chain assembly utilized by the entrapment device showing the horizontal ring of links interconnecting the bottom ends of the vertical chains.
Figure 10:
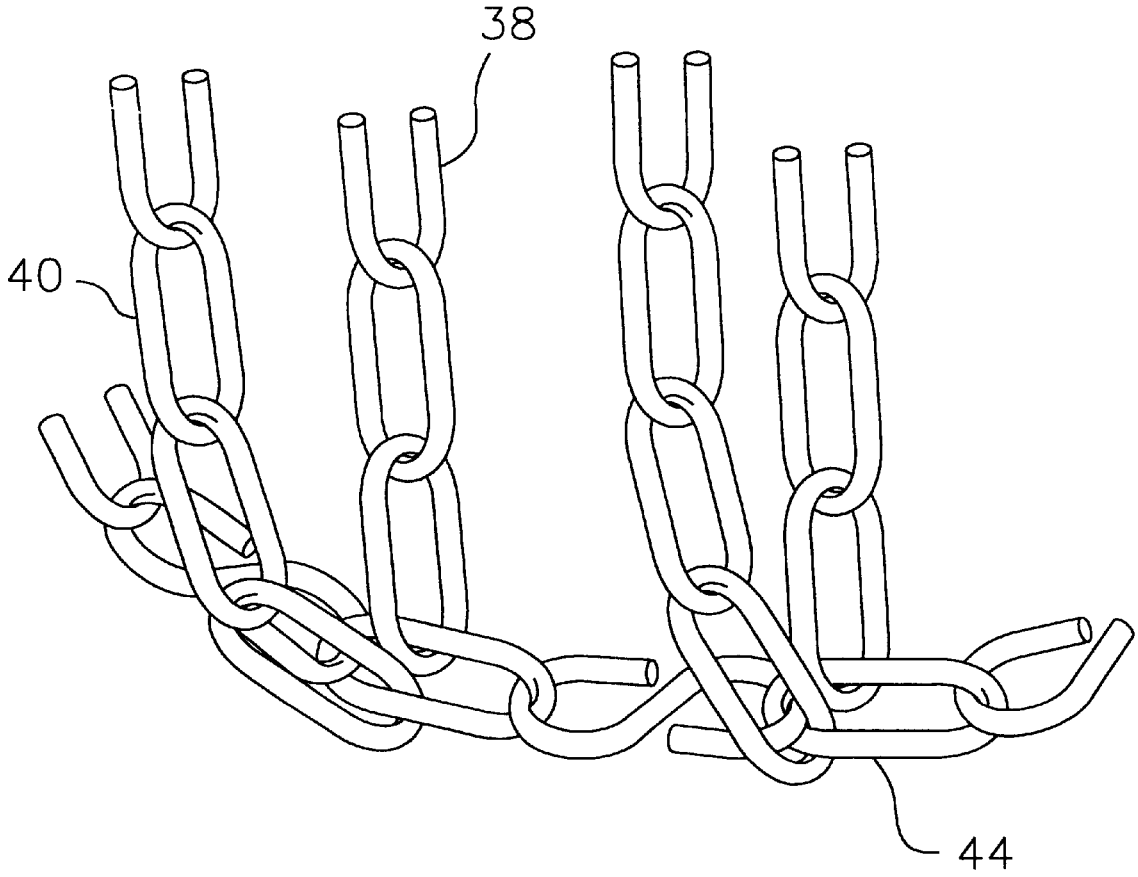
FIG. 10 is a view similar to FIG. 3 showing the use of S-hooks in the horizontal ring of links.

An enlarged fragementary view of the chain assembly is shown in FIG. 3. As shown therein, the outer chains 16 are illustrated as well as the inner chains 18. The lower ends of these chains are clearly illustrated and are shown as they are interconnected to the horizontal ring 23 of links 24 at the bottom of each of the chains. Links 24 can be conventional closed chain links or S-hooks. For S-hooks, see FIG. 10.

Figure 4:
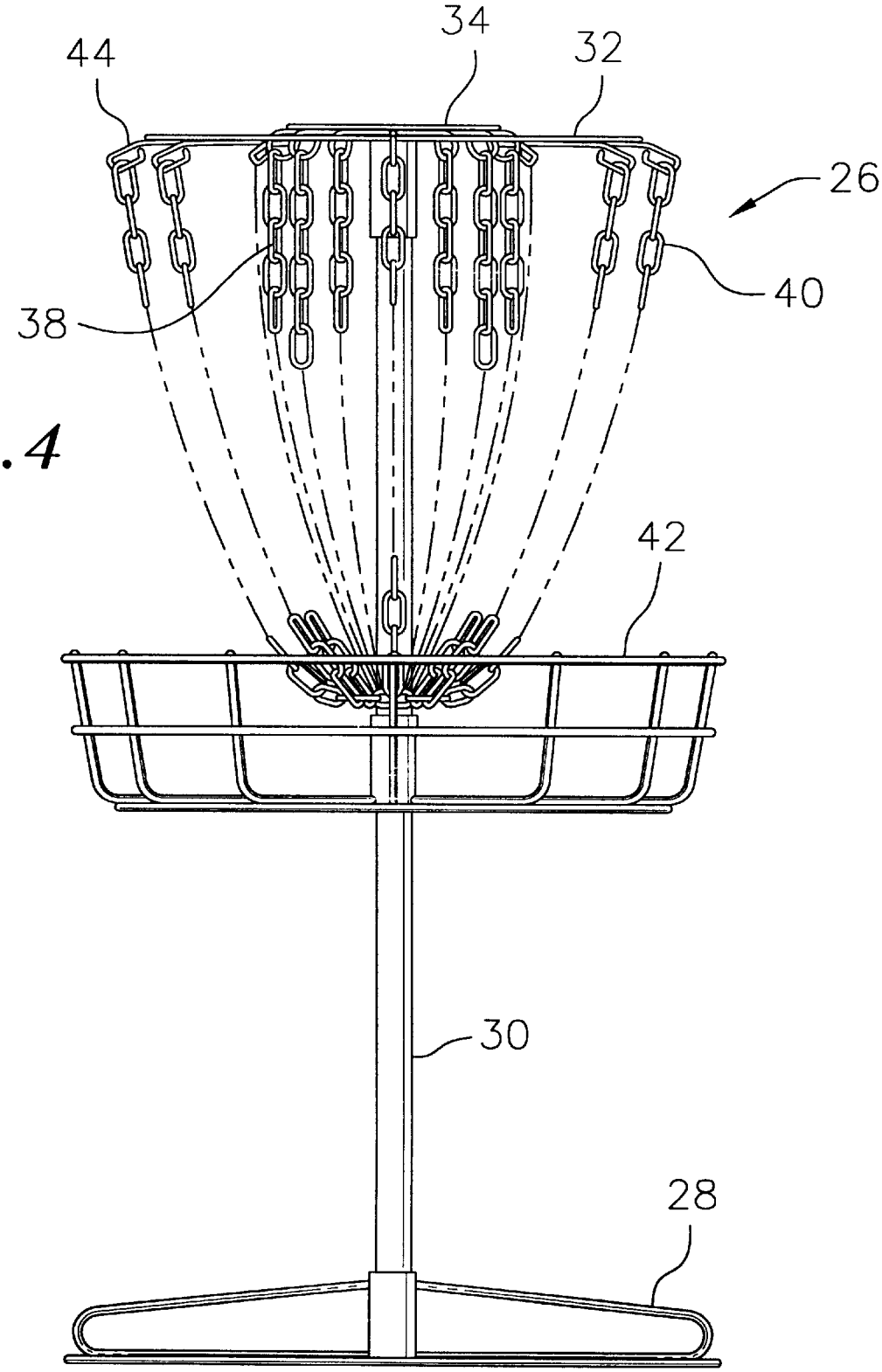
FIG. 4 is an elevation view of an alternate embodiment of the entrapment device according to the present invention.

An alternate embodiment of the disc entrapment device according to the present invention is shown in FIG. 4. As shown, the entrapment device 26 consists of a base 28, a central pole 30, and a chain support 32, mounted at the top of pole 30. The chain support consists of two rings 50, 52 respectively linked together by spokes. The rings are concentric with an inner ring 34 being located at a relatively close spacing to the pole and an outer ring 36 having a greater diameter and circumscribing the inner ring at a significantly greater distance.

In the presently preferred embodiment of the entrapment device of FIG. 4, there are at least seven (7) inner chains and at least seven (7) outer chains. As shown in FIG. 4, a set of seven (7) inner chains 38 are suspended from support 34. Likewise a set of at least seven (7) outer chains 40 are suspended from supports 42 connected to outer ring 32. The outer chains are mounted on sliding link supports such as are illustrated in U.S. Pat. No. 5,868,395. Secured to the pole at a point below the chain assembly is an upwardly opening basket 42 for receiving discs which have impacted the chains, their flight being terminated by the chain assembly and thereafter falling into the basket.

Figure 5:
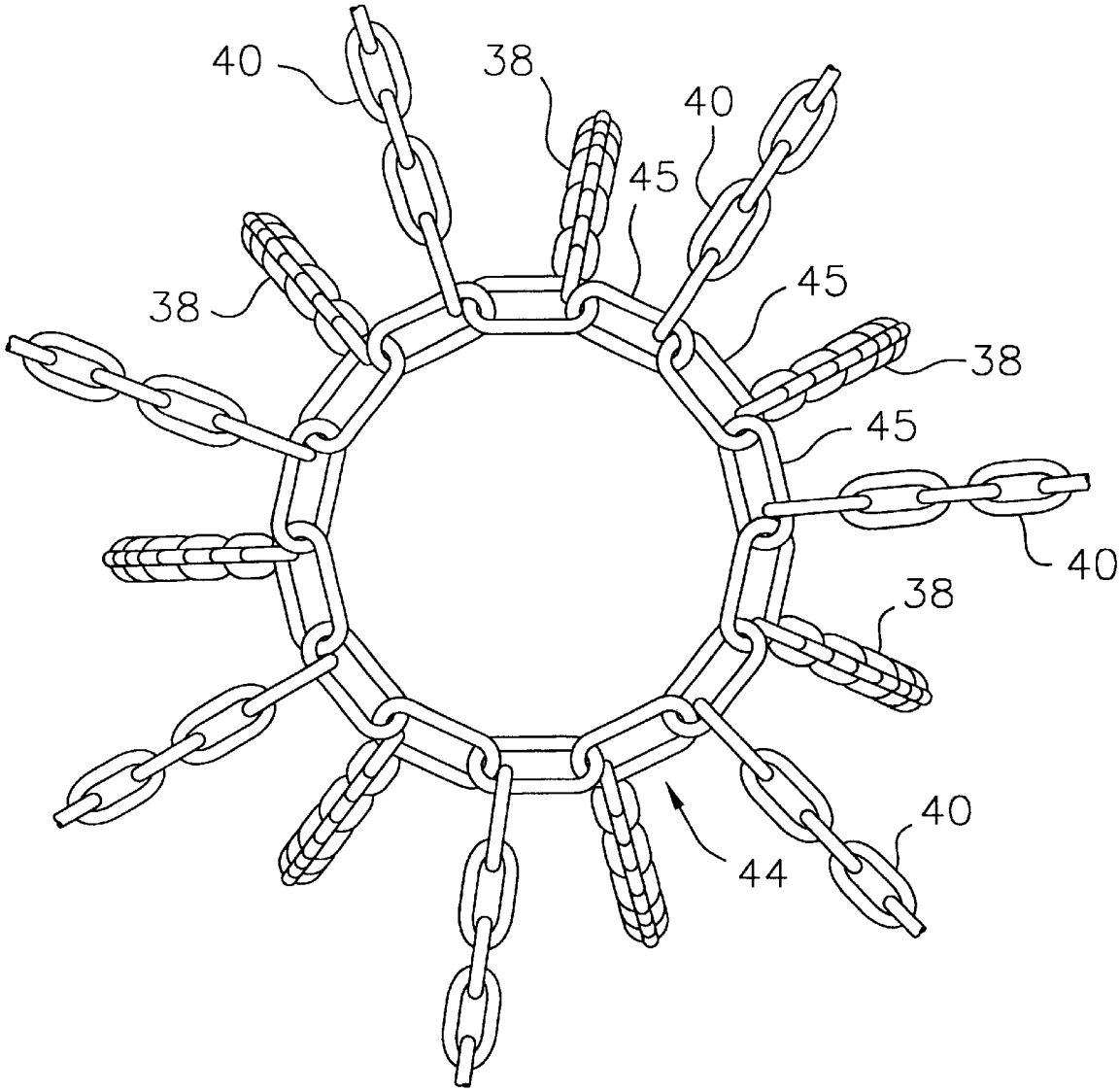
FIG. 5 is a view taken from below the chain assembly of the present invention looking upwardly showing the horizontal ring located at the bottom of the chains interconnecting the various chains of the entrapment device of FIG. 4.

Details of the chain assembly of the alternate embodiment of FIG. 4 are located in FIG. 5. As shown therein the outer chains 40 are shown at equally spaced intervals around the horizontal ring of chains 45 as are the inner chains 38. Each of the inner chains approximately bisects the angel between the two adjacent other chains. All chains are connected to a horizontal ring 44 of links 45 which interconnect the bottom ends of the chains and retain them in the position shown in FIG. 5. As is illustrated in FIG. 4, the shape of the chains approximates the curve of a parabola and the chains function to entrap and hold a flying disc as described in conjunction with the diagrams shown in FIGS. 8 and 9.

Figure 6:
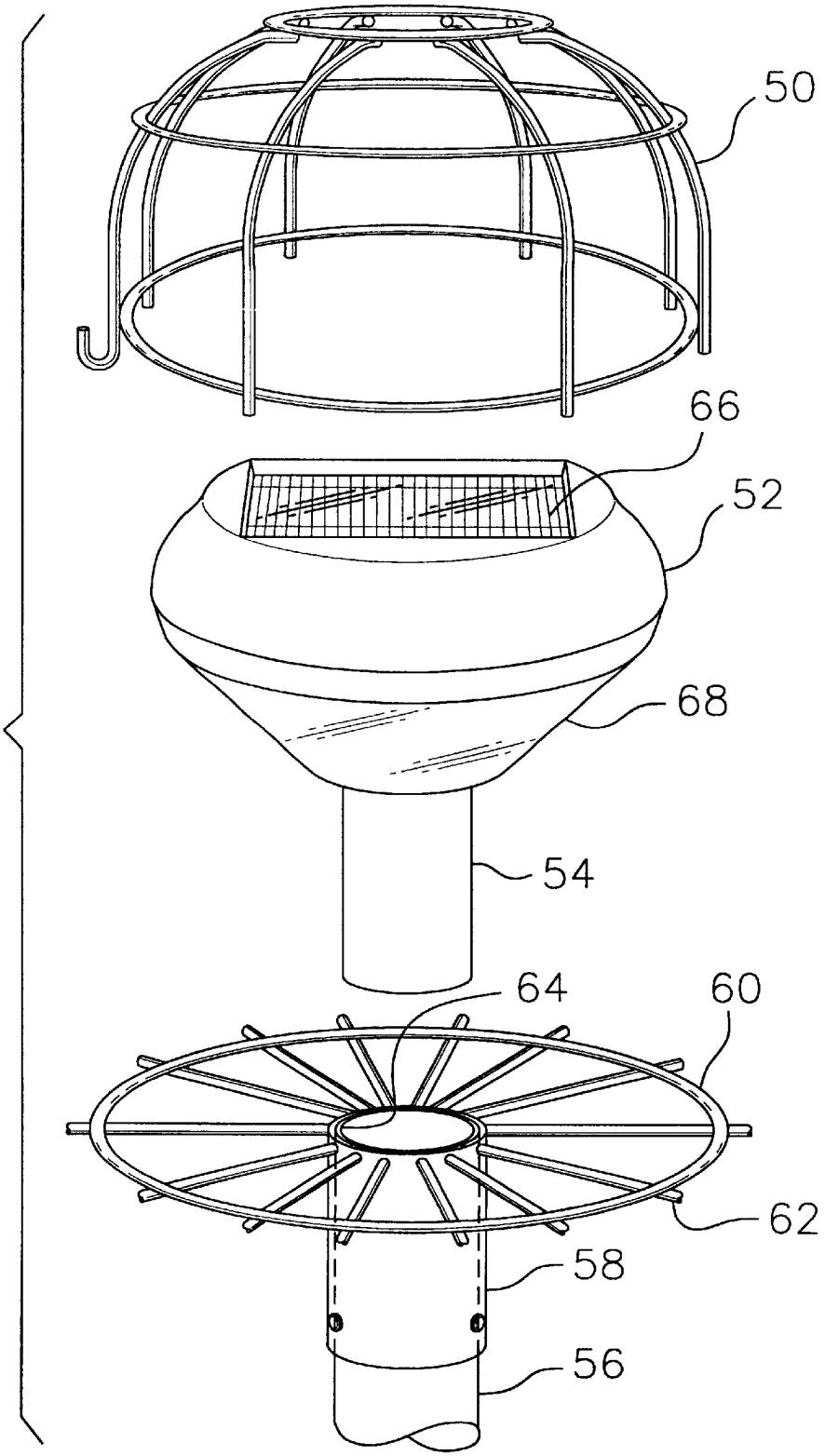
FIG. 6 is a exploded view of a solar cell/light adapted to be attached to the assembly entrapment device shown in FIG. 4.
Figure 7:
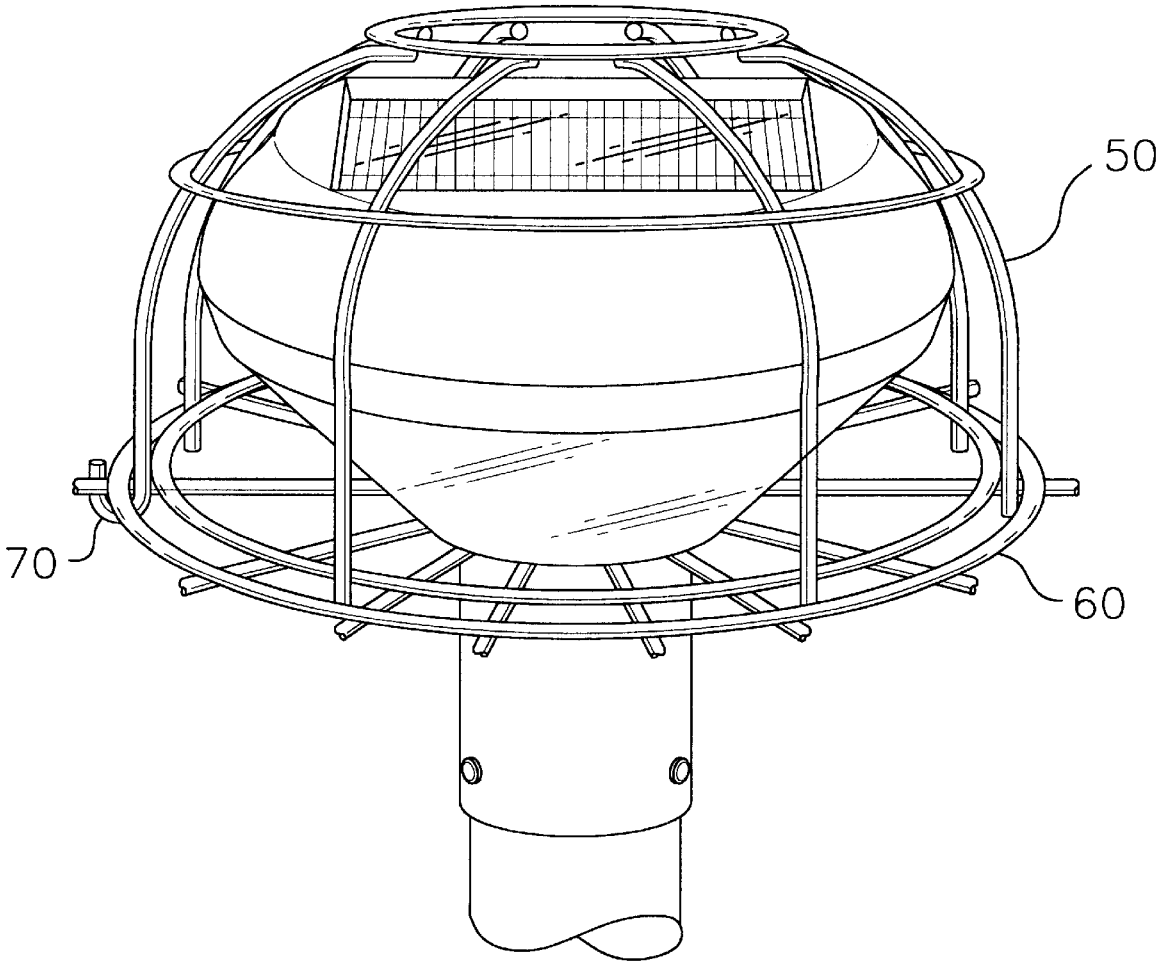
FIG. 7 is a perspective view of the solar cell/light assembly attached to the entrapment device.

A light conversion kit is shown in FIGS. 6 and 7 to provide illumination of the device when needed. As shown therein, the kit comprises a domed light cage 50, a solar light 52 and a mounting tube 54. The light conversion kit is adapted to be mounted to the top of a disc entrapment device and a portion of an entrapment device is shown in FIGS. 6 and 7. As shown therein, there is a central pole 56, a sleeve 58 mounted on the pole 56 and secured thereto. The sleeve 58 supports a ring 60 and support arms 62 which are utilized to support a set of inner chains. The assembly of the ring and support arms is affixed to sleeve 58 and the sleeve defines a central cylindrical opening 64 which is adapted to receive the mounting tube 54 on the bottom of the solar light. In one embodiment, the solar light 52 comprises a solar cell 66 which is utilized to power a light 68.

The light conversion kit is shown in its assembled position in FIG. 7 and as shown therein a hook 70 is provided on one of the vertical elements of the light cage 50 and is adapted to engage ring 60 and arm 62 as shown in FIG. 7. As shown in FIG. 7, the assembly is a temporary one which can be attached when it is desired to play under conditions where additional illumination of the entrapment device is needed and then can be slipped off and be carried away when play is completed. When a more permanent installation is desired, a padlock is provided which engages the cage 50, hook 70 and the ring 60 to lock the assembly in place.

Figure 8:
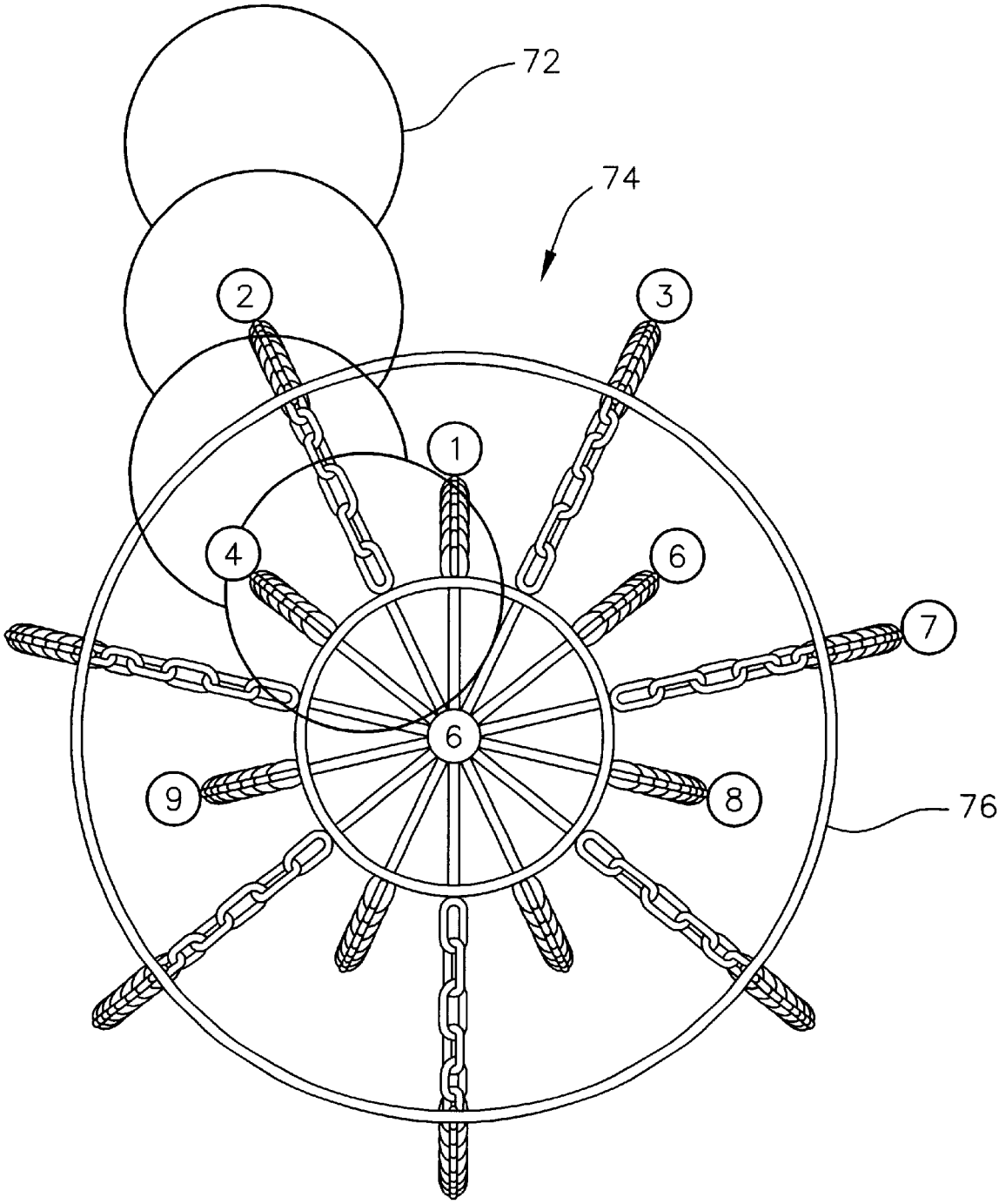
FIG. 8 is a diagram illustrating the disc catching capability of the entrapment device of FIG. 4.
Figure 9:
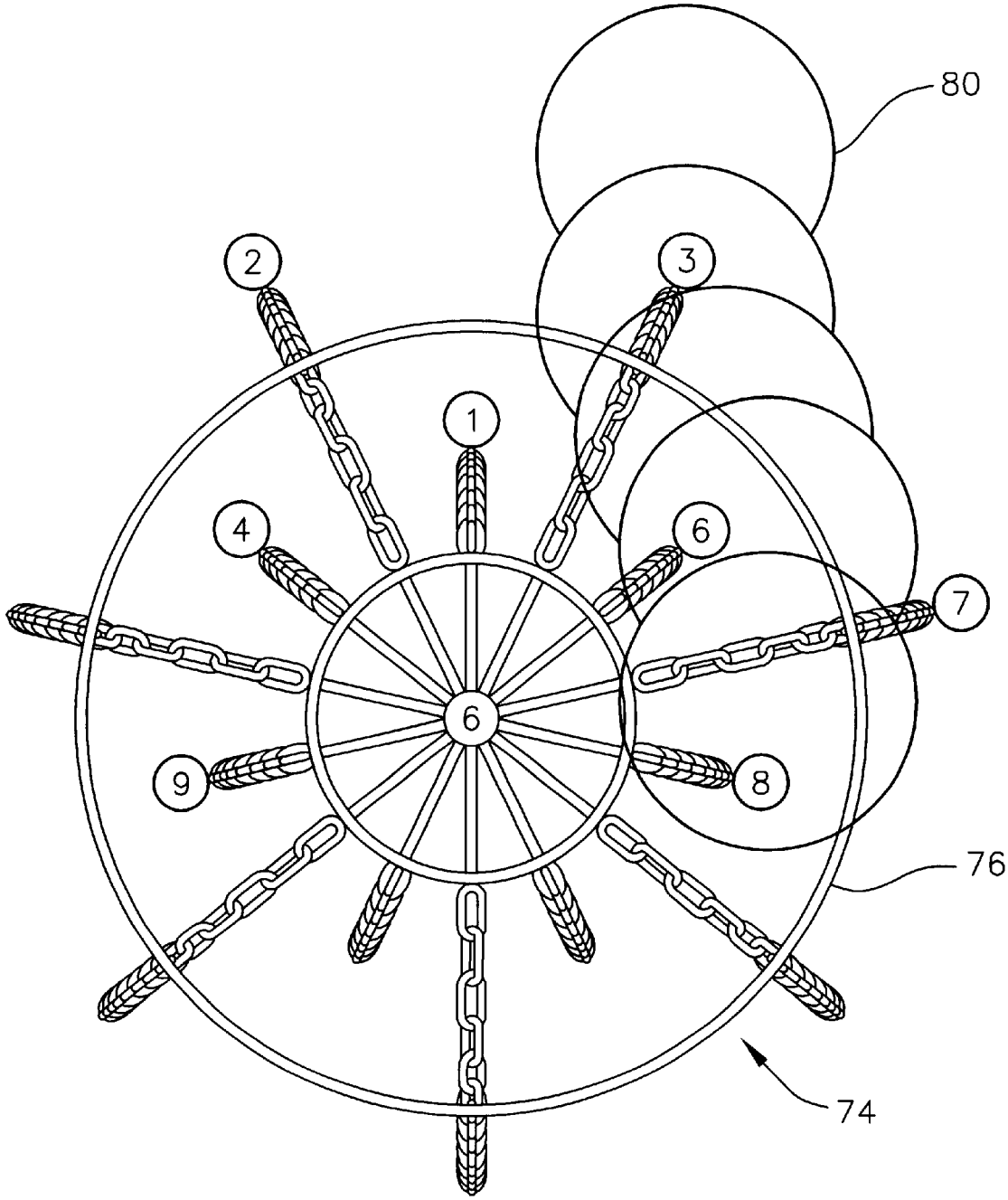
FIG. 9 is an additional diagram illustrating the disc catching capability of a disc approaching from a different angle.

A pair of diagrams in FIGS. 8 and 9 illustrate the disc catching ability of the entrapment device shown in FIGS. 4 and 5. In FIG. 8 a disc 72 is shown approaching an entrapment device 74 from the right side of the device as seen by the thrower. As shown in FIG. 8, certain of the chains are numbered and as shown therein, outer chains are identified by the numerals 2, 3, and 7. Inner chains are identified by the numerals 1, 4, 5, 8 and 9. The central pole is identified by numeral 6. As the incoming disc 72 hits chain number 2 and assuming that the disc is spinning clockwise as it would when thrown by a right-hand thrower, the disc impacts chain 2 and pushes chain 2 up slide 44 and then turns inwardly toward the center pole 6 where it impacts chains 1 and 4 and pole 6. The kinetic energy of the disc is effectively dissipated as the disc hits the pipe and the disc then drops into the basket which is diagrammatically illustrated at 76. Discs thrown by a left-handed thrower would have a counterclockwise spin and would tend to trace a path to the right of the central pole 6.

In FIG. 9 is illustrated a different flight path and, in this case, a disc 80 approaches the entrapment device 74 from the left side as seen by the thrower. The inner and outer chains are still identified by the same numbers as shown in FIG. 8. In this illustration disc 80 impacts the chain identified by numeral 3 and due to the spin of the disc it moves to the left where it strikes the chain identified by numeral 5 and an adjacent outer chain identified by numeral 7. The impact on chain number 7 deflects the disc into chain 8 effectively dissipating the kinetic energy of the disc and dropping it into the basket 76. As shown in FIGS. 4, 5, 8 and 9, a set of at least seven (7) chains is provided on the inner set and a set of at least seven (7) chains is provided on the outer set. This prime number of chains has been found to be particularly effective and sets itself up as a excellent entrapment device for novices and for practice purposes. Other chain configurations are possible as are illustrated in the related patents referenced above and each model and each configuration recommends itself for certain specific kinds of uses and applications.

What is claimed is:

1. A pole mounted chain and basket assembly for catching and holding flying discs comprising:

a vertically mounted elongated pole;

a first support extending radially outwardly a first distance from the pole adjacent the upper end of the pole;

a first plurality of vertically oriented inner chains, each of the chains being connected at spaced intervals at their upper end to the first support and at their lower ends being connected at spaced intervals to a horizontal ring of links extending between each vertical chain;

a second support extending radially outwardly from the pole a second distance greater than the first distance;

a second plurality of vertically oriented outer chains encircling the first plurality, each of the second plurality of chains being connected at spaced intervals at their upper ends to the second support and to the horizontal ring of links at their lower ends;

an upwardly opening basket of a predetermined size attached to the pole below the lower ends of the vertical chains; and the horizontally oriented links;

the links of each of the sets of chains being of a predetermined size and shape such that the assembly when struck by a flying disc acts to capture the disc, absorbing disc kinetic energy and causing the disc to fall into the basket.

2. An assembly according to claim 1 wherein the first support element comprises a plurality of radially extending inner support arms located at spaced intervals around the pole, each inner chain being attached to a different support arm at its upper end and to the horizontal ring at a point adjacent to the pole at its lower end.

3. An assembly according to claim 2 wherein the plurality of inner supports arms comprise seven (7) horizontally oriented rods disposed at equally spaced intervals around the pole with each vertically oriented chain being attached to a different rod at its upper end and to the horizontal ring at its lower end.

4. An assembly according to claim 3 wherein each chain comprises a plurality of links of a predetermined size and shape.

5. An assembly according to claim 4 wherein each link is an oblong closed loop chain link.

6. An assembly according to claim 1 wherein the second support is a dome with a plurality of apertures located at spaced intervals around the periphery.

7. An assembly according to claim 6 wherein the outer plurality of chains comprise seven (7) vertically oriented chains, each of the chains being engaged with one of the spaced apertures of the dome at its upper end and to the horizontal ring at its lower end.

8. An assembly according to claim 7 wherein each of the plurality of outer chains hang approximately perpendicular from the dome and loop upwardly to the point of attachment on the horizontal ring.

9. An assembly according to claim 8 wherein the vertical links are oblong closed loop chain links.

10. An assembly according to claim 9 wherein the horizontal ring comprise oblong closed loop chain links.

11. An assembly according to claim 4 wherein the horizontal ring comprises a plurality of S-hooks.

12. An assembly according to claim 6 wherein the dome incorporates a solar panel.

13. An assembly according to claim 12 wherein a light is incorporated into the dome and electrically connected to the solar panel for illuminating the assembly.

14. A pole mounted chain and basket assembly for catching and holding flying discs comprising:

a vertically mounted elongated pole;

a first set of at least seven (7) spaced apart support arms extending radially outwardly from the upper end of the pole a first predetermined distance;

a first set of at least seven (7) vertically hanging inner chains, each of the chains being connected at their upper end to one of the first support arms with the lower ends of each of the chains being engaged with a series of horizontally oriented chain links connecting the lower end of each vertical chain;

a second set of at least seven (7) spaced apart support arms extending radially outwardly from the pole a second distance greater than the first;

a second set of at least seven (7) vertically hanging outer chains encircling the first plurality, each of the second set of chains being connected at their upper ends to one of the second support arms and to the series of horizontally oriented links at their lower ends; each of the outer chains being located intermediate of the sector defined by a pair of adjacent inner chains;

an upwardly opening basket attached to the pole below the lower ends of the vertical chains; and the horizontal ring of links;

the relative placement of the inner and outer chains of each set of chains defining a plurality of disc catching pockets such that when the chains are struck by a flying disc the chains and pockets act to capture the disc, absorbing disc kinetic energy and causing the disc to fall into the basket.

15. An assembly according to claim 13 including a source of illumination detachably mounted on top of the pole.

16. A pole mounted chain and basket assembly for catching and holding flying discs comprising:

a vertically mounted elongated pole;

a first set of spaced apart support arms extending radially outwardly from the pole adjacent the upper end of the pole a first predetermined distance;

a first plurality of vertically oriented inner chains, each of the chains being connected at spaced intervals at their upper end to one of the support arms and the lower ends of each of the chains being connected to a horizontal ring of links;

a circular dome mounted on the pole having a radius greater than the length of the first support arms a source of illumination incorporated into the dome;

a second plurality of vertically oriented outer: chains: encircling the first plurality, each of then chains being connected at spaced intervals at their upper ends to the rim of the circular dome and to the horizontal ring of links at their lower ends;

an upwardly opening basket attached to the pole below the lower ends of the vertical chains; and the horizontally oriented links;

the second plurality of chains being of a predetermined length greater than the first plurality such that each chain in said second plurality extends below the plane defined by the horizontal links and loops upwardly to the point of attachment on the horizontal ring.

17. An assembly according to claim 15 wherein the source of illumination is a solar lamp.

* * * * *